US006471571B2

(12) United States Patent
Oliver

(10) Patent No.: US 6,471,571 B2
(45) Date of Patent: Oct. 29, 2002

(54) SUBSTRATE SUPPORTING CARRIER PAD

(75) Inventor: Michael R. Oliver, Portland, OR (US)

(73) Assignee: Rodel Holdings, Inc., Wilmington, DE (US)

( * ) Notice: Subject to any disclaimer, the term of this patent is extended or adjusted under 35 U.S.C. 154(b) by 0 days.

(21) Appl. No.: 09/933,190

(22) Filed: Aug. 20, 2001

(65) Prior Publication Data

US 2002/0025769 A1 Feb. 28, 2002

Related U.S. Application Data

(60) Provisional application No. 60/227,128, filed on Aug. 23, 2000.

(51) Int. Cl.[7] ..... B24B 5/00

(52) U.S. Cl. ..... 451/287; 451/288; 451/398

(58) Field of Search ..... 451/41, 63, 285, 451/287, 288, 289, 398, 397

(56) References Cited

U.S. PATENT DOCUMENTS 5,449,316 A 9/1995 Strasbaugh
5,635,083 A * 6/1997 Breivogel et al. ..... 451/288
5,795,215 A * 8/1998 Guthrie et al. ..... 451/288
5,851,140 A * 12/1998 Barns et al. ..... 451/288
5,913,718 A * 6/1999 Shendon ..... 451/288
5,931,719 A 8/1999 Nagahara et al.
5,931,725 A * 8/1999 Inaba et al. ..... 451/288
6,080,050 A 6/2000 Chen et al.
6,135,858 A 10/2000 Kazuo
6,176,764 B1 * 1/2001 Gotcher ..... 451/288
6,210,255 B1 * 4/2001 Zuniga et al. ..... 451/288
6,264,540 B1 * 7/2001 Fruitman ..... 451/398

FOREIGN PATENT DOCUMENTS

EP 0 879 678 A1 11/1998
WO WO 00/13851 A1 3/2000

OTHER PUBLICATIONS

Patent Abstracts of Japan, vol. 1999, No. 04, Apr. 30, 1999.

* cited by examiner

*Primary Examiner*—M. Rachuba
(74) *Attorney, Agent, or Firm*—Gerald K. Kita; Kenneth A. Benson

(57) ABSTRACT

A carrier head assembly of a substrate polishing apparatus and a substrate supporting carrier pad is disclosed. A down force is uniformly distributed over the backside of the substrate by the carrier pad adapted to be internally pressurized by the down force.

19 Claims, 6 Drawing Sheets

SUBSTRATE SUPPORTING CARRIER PAD

CROSS REFERENCE TO RELATED APPLICATION

This application claims the benefit of U.S. Provisional Patent Application Ser. No. 60/227,128 filed Aug. 23, 2000.

FIELD OF THE INVENTION

The present invention relates generally to a substrate polishing apparatus for chemical mechanical polishing of a semiconductor substrate. More specifically, the present invention is directed to a substrate supporting pad, to the various constructions and compositions of such a pad, and to polishing apparatus using such a pad to support a substrate during polishing.

BACKGROUND OF THE INVENTION

Chemical mechanical polishing (CMP) is a process performed by a substrate polishing apparatus for planarizing or polishing semiconductor substrates, also known as substrates, to provide substantially planar front and/or backsides thereon. The CMP process is used to remove high elevation features, or other discontinuities, which are created during the fabrication of semiconductors on the substrate.

The CMP process is performed by a substrate polishing apparatus having a carrier head assembly that removably retains a substrate to be polished, the carrier head urging the substrate against a rotating polishing pad. Further, the carrier head assembly may or may not rotate and translate the substrate relative to the rotating polishing pad. As the polishing pad rotates, it tends to pull the substrate from beneath the carrier head assembly. To eliminate this problem, the carrier head assembly includes a substrate confining ring that extends circumferentially around the lateral edge of the substrate, and retains the substrate and limits movement of the substrate relative to the carrier head assembly. In addition, a controllable down force is applied on the substrate to urge it against the polishing pad.

A down force is applied according to U.S. Pat. No. 5,795,215 that discloses a carrier head assembly with a vertically expandable bellows chamber wherein fluid, preferably air, is pumped into and out of a primary pressure chamber to control the load to be applied to a substrate. When air is pumped into the primary pressure chamber, the pressure in the chamber increases and a base assembly is pushed downwardly. A substrate backing member is attached by a vertically expandable bellows. The bellows and the substrate backing member may be formed of stainless steel.

A down force is applied according to U.S. Pat. No. 5,449,316 that discloses a carrier head assembly for polishing a substrate by providing a downwardly opening plenum covered by a flexible membrane. When pressurized fluid is introduced to the plenum, the membrane applies a uniform downward pressure across a backside of a substrate to be polished. The membrane is several hundred microns in thickness and is composed of a synthetic rubber.

A down force is applied to a substrate according to U.S. Pat. No. 5,931,719 that discloses an inflatable bladder located beneath the polishing pad. The inflated bladder is used to vary the pressure exerted against the bottom of the polishing pad, which results in varying the down force of a substrate that is held against the top surface of the polishing pad. Varying the pressure is said to compensate for center slow polishing arising when a polishing pad has been used repeatedly for polishing multiple substrates.

Undesired overpolishing of the substrate can be attributed to a warped or otherwise unevenly planar substrate, and by the manner in which the substrate is retained to the carrier head assembly. The carrier head assembly includes a generally planar lower carrier face or platen on which is mounted a conformable and resilient carrier pad film in the form of a thick, resilient and solid film that contacts the backside of the substrate. The conformable and resilient carrier pad film may be a poromeric carrier pad film, commercially available from Rodel, Inc., Newark, Del. USA, and known as "DF-200" and "R200T3" or "R200T4-470-510". Such a carrier pad film is a dense, porous, closed-cell polymer foam having a thickness generally less than 0.030 in. thick. When wetted, a fluid surface tension is provided for adhesion of a substrate in contact with the carrier pad film. Alternatively, a conformable carrier pad film may be provided by a wax mound against which the substrate is pressed to form a conformable film surface to receive a substrate for polishing. The wax material has limited resiliency.

The lower carrier face may lack a desired planar orientation, and may include protrusions or be misaligned from planar, all of which are irregularities that contribute to uneven distribution of a down force against the carrier pad film, and, in turn, against the backside of the substrate during polishing. Such uneven distribution will exert localized higher down force distribution on a portion of the substrate, which contributes to uneven rates of polishing and deviation from a planar polished surface on the substrate. Further, the substrate may become over-polished at a locations of localized higher down force distribution, which reduces the yield of useable planar semiconductor areas on the substrate. A conformable and resilient carrier pad film provides only limited improvement in attaining an even distribution of the applied down force. For example, the load distributing properties of the carrier pad are limited, and are often inadequate to compensate or overcome misalignment of the lower carrier face itself, and misalignments of the carrier pad film and the substrate on the lower carrier face. The carrier pad film itself may have variations in its thickness and constituent construction that might contribute to nonuniform distribution of down force. Further, the compressibility of a carrier pad film is limited by the amount of compression provided by its limited resiliency. A need exists for a conformable carrier pad that is more compressible than the resiliency provided by a carrier pad film, and that can be sufficiently compressible and/or resilient to compensate for uneven distribution of applied down force, as provided by a misaligned carrier face and by protrusions on the carrier face.

A recurring problem in chemical mechanical polishing is the so-called "edge effect", i.e., the tendency of the substrate edge to be polished at a different rate than the center of the substrate. The edge effect typically results in overpolishing or under-polishing in spite of the use of carrier films. Further, variations in the composition and construction of the carrier film itself can contribute to nonuniformly distributed, localized pressure zones at certain areas across the contacting surface on the carrier film and, hence, across the substrate to be supported by the contacting surface.

The compressibility of a resilient film carrier pad is limited, and the resultant pressure on the substrate is directly proportional to the degree of resilient compression by the carrier pad. Since in practice, the film carrier film must be changed regularly, it would be desirable to provide carrier pads of uniform construction and of uniform composition from one carrier pad to another, which enables the same level of internal pressurization.

SUMMARY OF THE INVENTION

The present invention provides a carrier head assembly for a substrate polishing apparatus applying uniform down force distribution against a substrate by using an internally pressurizable carrier pad. Advantageously, the internally pressurized carrier pad conforms to, and thereby compensates for, variations in substrate thickness, carrier assembly irregularities, and avoids the limits to compressibility and the nonuniform distribution of down force due to variations in composition and thickness, as provided by conformable and resilient carrier pad films.

Embodiments and advantages of the invention will become apparent by way of example from the following detailed description taken in conjunction with the accompanying drawings.

DETAILED DESCRIPTION

Figure 1:
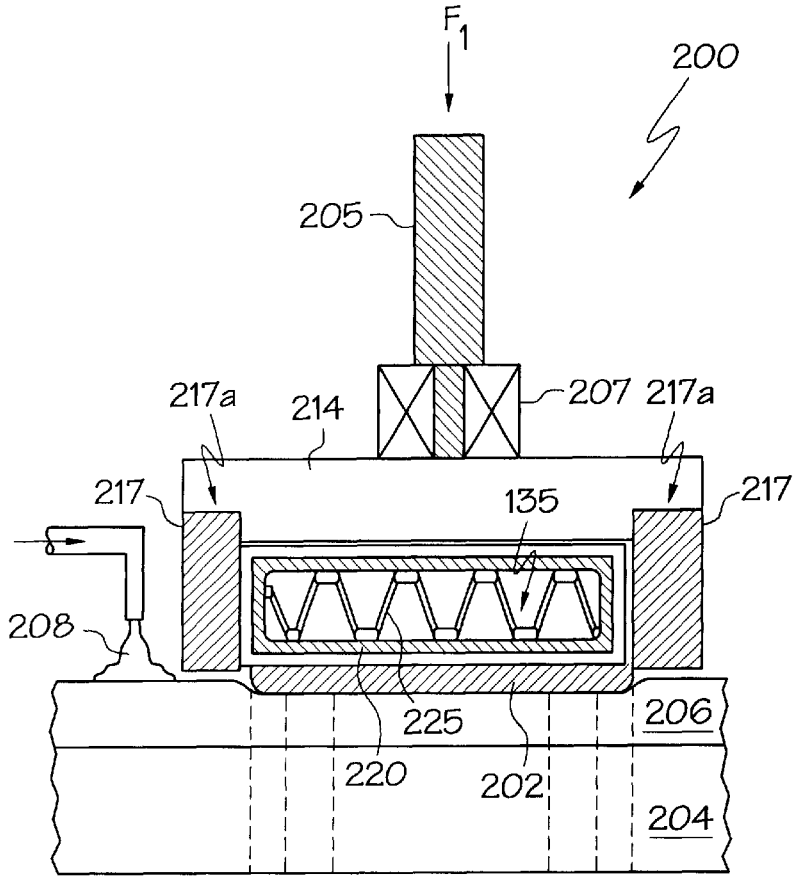
FIG. 1 is a diagrammatic view in section of a carrier head assembly of a substrate polishing apparatus, which includes a reinforced embodiment of a hollow, fluid filled carrier pad for supporting a substrate to be polished.

An embodiment of the present invention provides apparatus and a system of polishing a substrate wherein, a hollow, fluid filled carrier pad of simplified mechanical construction is adapted to be internally pressurized by the down force and provide uniform distribution of the down force over a backside of a substrate, with the internal pressure of the carrier pad providing the carrier pad with conformance to irregularities that would contribute to nonuniform distribution of the down force, while minimizing a need for adjustment of the carrier pad during its use. When used in combination with a carrier pad film the hollow, fluid filled carrier pad will compensate for irregularities in the carrier pad film that would contribute to nonuniform distribution of a down force.

Further, the invention provides a carrier head assembly of a substrate polishing apparatus. A substrate is supported by the carrier head assembly, and is held face down to face a moving polishing pad, such that the substrate surface to be polished is urged against the moving polishing pad. A down force is uniformly distributed over the backside of the substrate by a substrate supporting carrier pad adapted to be internally pressurized by the down force, the carrier pad being in the form of a hollow, sealed, hollow, fluid filled chamber provided as a gas filled or liquid filled, closed bladder, which can be used in concert with a fluid that provides surface tension adhesion of a supported substrate to be polished. A slow leak in a liquid filled chamber is easily detected by monitoring for the presence of the liquid at the backside of the substrate that is supported by the liquid filled chamber that is leaking. For example, if the liquid filled chamber leaks deionized water, the chemical concentration of the polishing fluid is monitored, and will become diluted, at the backside of the substrate, by any deionized water leaking from the liquid filled chamber. Further, for example, if the liquid filled chamber leaks a liquid that has an inert coloring agent, the backside of the substrate is monitored for the coloring agent that might leak from the liquid filled chamber. Further, for example, a slow leak in a gas filled chamber or liquid filled chamber is easily detected by monitoring the chamber dimensions during a polishing operation, and detecting a cumulative decrease in the chamber dimensions over time, as being indicative of a slow leak. To prevent collapse of the chamber, the inherent stiffness of the chamber materials and any optional internal webs will support the chamber that has lost a substantial portion of its internal pressure.

Advantageously, the chamber is of a construction adapted for assembly within a substrate confining ring on the carrier head assembly. The chamber is adapted to be compressed by the carrier head assembly, and to become internally pressurized with a uniform internal pressure that uniformly distributes a down force over the backside of a substrate to be polished.

The invention further provides a substrate supporting carrier pad having a hollow, sealed, hollow, fluid filled chamber. According to an embodiment, the hollow, fluid filled chamber has a united exterior wall. The united exterior wall is of united multi-wall construction or of united unitary blow molded construction. Advantageously, the chamber is adapted to be compressed during a substrate polishing operation to become internally pressurized with a uniform internal pressure that uniformly distributes a down force over the backside of a substrate to be polished.

The invention provides a substrate supporting carrier pad having a hollow, sealed, fluid filled chamber adapted to be compressed during a substrate polishing operation to become internally pressurized with a uniform internal pressure that uniformly distributes a down force over the backside of a supported substrate to be polished.

Further, the invention provides a carrier head assembly of a substrate polishing apparatus, having a substrate confining ring and a pressure exerting, substrate supporting carrier pad adapted for assembly within the substrate confining ring, the carrier pad being in the form of a hollow, sealed, hollow, fluid filled chamber that can be used in concert with a fluid providing surface tension adhesion of a substrate to be polished, the chamber further being adapted to be compressed by the carrier head assembly, and become internally pressurized with a uniform internal pressure that uniformly distributes a down force over the backside of a supported substrate to be polished.

With reference to FIG. 1, a carrier head assembly 200 of a known apparatus for polishing a semiconductor substrate is provided to hold a semiconductor substrate 202 face down to face a rotating table 204 covered with a polishing pad 206 that may or may not be coated with active slurry from a slurry dispenser 208. A circular, stainless steel, lower carrier face 214 or platen is attached to a steel rotatable drive shaft 205 by a flexible coupling 207, such as a gimbal that corrects for angular misalignments. The lower carrier face 214 is typically a thick, nonflexible metal plate resisting movement of the substrate 202 facing the backside of substrate 202. A wear-resistant substrate confining ring 217, made of, for example, ceramic, plastic, or composite material, is attached to the outer circumference of the lower carrier face 214. The ring 217 centers substrate 202 on the carrier head assembly 200 and prevents it from slipping laterally. The ring 217 may be maintained in a withdrawn position upwardly so as to not be in contact with polishing pad 206 during polishing. A hollow, fluid filled carrier pad 220 may be combined with a conventional carrier pad film, not shown, by being stacked one on the other, to support the substrate 202 during polishing. The carrier pad 220 may support the substrate 202 without a conventional carrier pad film. Thus, the carrier pad 220 is a substitute for the conventional carrier pad film. The carrier pad 220 is mounted on the lower carrier face 214, and becomes compressed and undergoes uniform internal pressurization.

The sealed, hollow, fluid filled carrier pad 220 undergoes compression and uniform internal pressurization by application of the down force $F_1$. The uniform internal pressure of the hollow, fluid filled carrier pad 220 uniformly distributes the down force over the backside of substrate 202 supported by the carrier pad 220. The uniformly distributed down force $F_1$ and the rotational movement of pad 206, acting together with the slurry, facilitate abrasive and planar removal of the surface of the substrate during polishing. The carrier head assembly 200 is rotated by rotation of the shaft 205 to enhance uniformity of planar polishing. The carrier head assembly 200 may undergo translation due to translation of the rotating shaft 205 during polishing.

A down force $F_1$ is uniformly distributed over the backside of the substrate 202 by the substrate supporting, hollow, fluid filled carrier pad 220 adapted to be internally pressurized by the down force $F_1$, the carrier pad 220 being in the form of a hollow, sealed, hollow, fluid filled chamber 135 that can be used in concert with a fluid providing surface tension adhesion of a supported substrate 202 to be polished. Advantageously, the chamber 135 is of a construction adapted for assembly within a substrate confining ring 217 on the carrier head assembly 200. The chamber 135 is adapted to be compressed by the carrier head assembly 200, and to become internally pressurized with a uniform internal pressure that uniformly distributes a down force $F_1$ over the backside of a substrate 202 to be polished.

The invention further provides a substrate supporting carrier pad 220 having a hollow, sealed, hollow, fluid filled chamber 135. According to an embodiment, the hollow, fluid filled chamber 135 has a united exterior wall 221. The united exterior wall 221 is of united multi-wall construction or of united unitary blow molded construction. Advantageously, the chamber 135 is adapted to be compressed during a substrate polishing operation to become internally pressurized with a uniform internal pressure that uniformly distributes a down force $F_1$ over the backside of a substrate 202 to be polished.

The ring 217 is optionally adjusted in position by inserting a conventional shim 217*a* in between the ring 217 and the lower carrier face 214. According to FIG. 1, the lower surface of the ring 217 is located at a predetermined gap above the surface of polishing pad 220. The gap is sufficient to compensate for a reduction in height of a sealed, hollow, fluid filled carrier pad 220 when such carrier pad 220 is compressed by down force $F_1$.

When no gap is desired between the ring 217 and the polishing pad 220, the height of the ring 217 can be adjusted to contact, or to provide a down force on the polishing pad 220. In this embodiment, the ring 217 and the substrate 202 are each forcibly pressed against the polishing pad 220 by the applied down force.

To provide the gap between the lower surface of the ring 217 and upper surface of the polishing pad 220, due to chamber compression, the vertical gap between the edge ring 217 and the polishing pad 220 can be adjusted by preselecting a ring 217 with a desired vertical dimension, or by adjusting a given ring 217 with the use of a shim 217*a*, in order to maintain a desired gap, if any, desired between the lower surface of the ring 217 and the upper surface of the polishing pad 220. Thus, to maintain a preselected gap between the ring 217 and the polishing pad 220, the thickness of the wear ring may be varied to compensate for the thickness, and compression of the hollow, fluid filled carrier pad 220. A ring 217 of fixed thickness can be combined with a shim 217*a* of preselected thickness, thereby providing a designated operating gap to accommodate both the hollow, fluid filled carrier pad 220 and substrate 202 and optional carrier pad film.

A sealed, hollow, fluid filled carrier pad 220 in FIG. 1 has a united exterior wall 221 surrounding and defining a sealed, hollow, fluid filled chamber 135. As disclosed by FIG. 3, the united exterior wall 221 has a face wall or planar platen wall 101 against which is supported the substrate 202 during polishing. An optional carrier pad film is supported by the platen wall 101 during polishing, the carrier pad film contacting the substrate 202. The united exterior wall 221 has a back wall or planar rear wall 134 that is spaced apart from the platen wall 101. The rear wall 134 is adapted to mount to the lower carrier face 214, for example, by using fastener means such as an adhesive or spike like protrusions. A perimeter wall 102 bridges between the platen wall 101 and the rear wall 134, and is united therewith according to processes discussed hereafter.

As disclosed by FIG. 1, the chamber 135 is internally reinforced by optional inner perforated supporting webs 225 bonded to the interior of the united exterior wall at selected points to provide dimensional stability against excessive shape deformation of the outer wall. The perforations of the perforated supporting webs 225 freely transmit fluid that is distributed throughout the chamber 135, the chamber 135 serving as a single hollow, fluid filled cell. Supporting webs 225 may be especially desirable when employed in conjunction with a low gauge thickness (<20 mils) platen wall 101 to provide dimensional stability for withstanding rotational torque. The dimensions and flexural properties of the optional internal supporting webs 225 can be designed to minimize surface pressure non-uniformities in the pad 220 in its compressed state. Further, consideration should be given to the influences on the pressure profile across the pad 220, as influenced by the gauge thickness and flexural properties in the material of the platen wall 101, the height of the open space between the platen wall 101 and rear wall 134, and the spatial arrangement and crossectional area of the supporting webs 225. These design parameters can be readily modeled and determined by computation and/or reasonable trial and error refinement.

The perforated webs 225 can be provided by a resilient, crosslinked perforated polymeric film, or scrim, separately formed into the webs 225 that are subsequently bonded to the interior of the platen wall 101 using heat and pressure to form a heat seal or by the use of an adhesive. Alternatively, the webs 225 are integrally molded with the platen wall 101 during fabrication by a conventional molding process.

Figure 2:
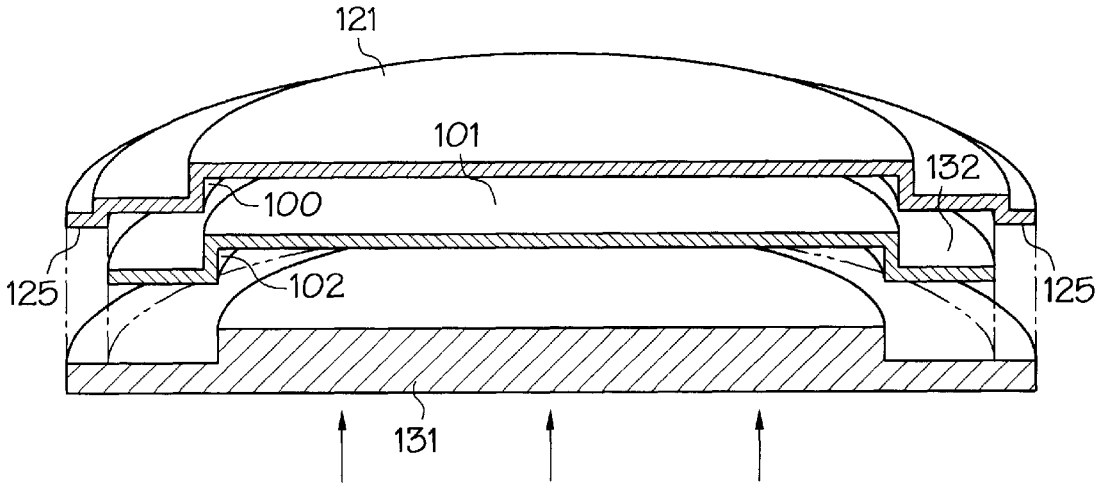
FIG. 2 is an isometric view with parts shown broken away of molding dies for forming a portion of an exterior wall of a hollow, fluid filled carrier pad.

As disclosed by FIG. 2, the chamber 135 of the hollow, fluid filled carrier pad 220 is fabricated, for example, by a molding process wherein a lower, planar face wall or substrate supporting platen wall 101 of the united exterior wall of the carrier pad 220 is formed and shaped in a mold cavity 100 defined between a pair of mating mold dies 121 and 131. The mold dies 121 and 131 face each other and abut each other, i.e. mating, along a mold parting line 125. Material in a fluent state to be molded is injected into the mold cavity 100 and molded to a desired shape and volume within the mold cavity, according to an injection molding process. Alternatively, the fluent state material to be molded is introduced into the mold cavity 100, and is shaped in the mold cavity 100 by pressurized air, according to a blow molding process. Alternatively, the material to be molded is introduced into the cavity in the form of a solid thin film, and heated and softened to a pliant state, and then molded to a desired shape and volume within the mold cavity 100, according to a film compression molding process.

Referring to FIG. 2, the mold dies 121 and 131 close and abut each other along the mold parting line 125, with either the film therebetween, or alternatively, with material in a fluent state to be molded in the mold cavity 100 defined by the closed and abutting mold dies 121 and 131. Film in the softened pliant state, or alternatively, the introduced material, undergoes flow to fill the volume of the mold cavity 100 to form the planar platen wall 101 having an exterior surface of desired planarity and having a desired thickness, and having a perimeter wall 102 united with the planar platen wall 101 and perpendicular to the planar platen wall 100. According to an alternative embodiment, the perimeter wall 102 is formed by a correspondingly shaped mold cavity 100 that is sloped relative to the plane of the planar platen wall 101, providing a sloped perimeter wall 102, and a shallow dish appearance.

According to an embodiment, the film 101, or alternatively, the injected material, undergoes flow within the mold cavity 100 to form a smooth, flat perimeter flange area 132 united with the perimeter wall 102 and projecting laterally and peripherally outward. The flange area 132 is formed adjacent to the mold parting line 125 where the mold dies 121 and 131 meet each other during the molding operation. Some of the fluent molded material flows along the mold parting line 125 to form mold flash, referring to an undesired bead of molded material that extends in a crease formed by the mold parting line 125 and deposits on the surface of the molded part, namely, the outermost perimeter edge on the perimeter flange area 132. The molded material is cooled to a solidified state, the mold dies 121 and 131 are opened, and the mold die 131 is removed, leaving the molded material in the mold die 121, FIG. 3.

Figure 3:
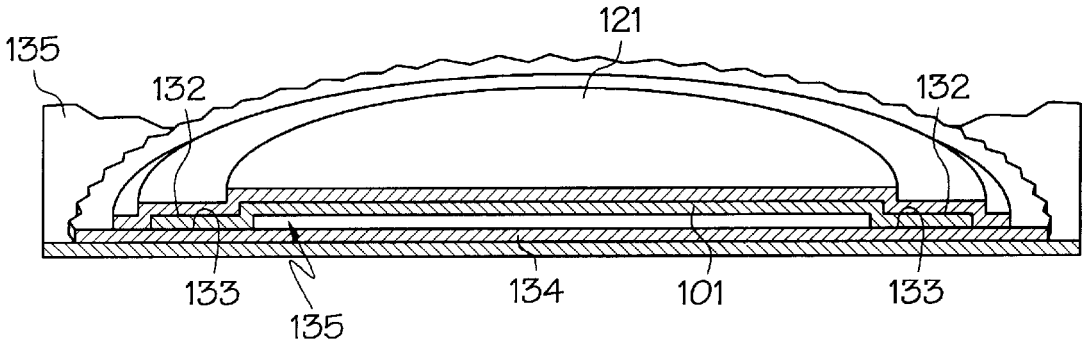
FIG. 3 is an isometric view with parts shown broken away of a carrier pad prior to trimming, with a wall retained within a mold die, and another wall provided by a film.

With reference to FIG. 3, the flange area 132 is sealably joined, by lamination, by application of adhesive or by heat sealing, to a planar rear wall 134 of the united exterior wall of the carrier pad 220. The rear wall 134, of desired planarity and thickness, is provided by a film of material supported on a flat heated anvil surface 135. The flange area 132 and the rear wall 134 provided by the film are overlapped and are united. For example, heat and pressure are applied to the overlapping flange area 132 and the rear wall 134 to unite the platen wall, the perimeter wall and the rear wall 134, by sealably uniting the overlapping flange area 132 and the rear wall by fusion bonding under heat and pressure. The sealably united flange area 132 and the rear wall 134 form a perimeter, sealably united area 133. Alternatively, the sealably united area 133 is formed by application of adhesive to the overlapped flange area 132 and rear wall 134. A portion of the sealably united area 133, including a portion of the flange area 132, are trimmed off by a stamping operation using a stamping die, leaving a flange 140 of desired lateral perimeter dimensions, FIG. 4. The mold flash on the outermost edge of the flange area 133 is advantageously trimmed off together with the remainder of the flange area 133.

In an another embodiment of the invention, the back wall or rear wall 134 is formed with one, or preferably more than one, or several protrusions or recesses designed for interlocking with a complementary shaped surface provided by the carrier base, carrier face or platen 214, or by an attached insert on the carrier base, carrier face or platen 214.

Figure 3A:
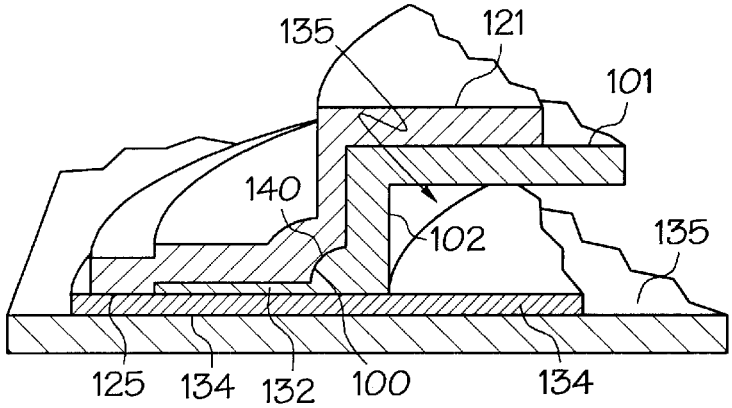
FIG. 3A is a fragmentary view with parts broken away and with parts in section of mold dies forming a flange area.

According to another embodiment, FIG. 3A, the united exterior wall 221 is shaped with a smooth, rounded lateral perimeter flange 140 formed in a mold cavity 100 having complementary rounded surfaces. The flange area 132 that projects beyond the rounded perimeter flange 140 is subsequently trimmed off, leaving the flange 140 in a rounded configuration that opposes and engages the interior of the confining ring 217.

Figure 3B:
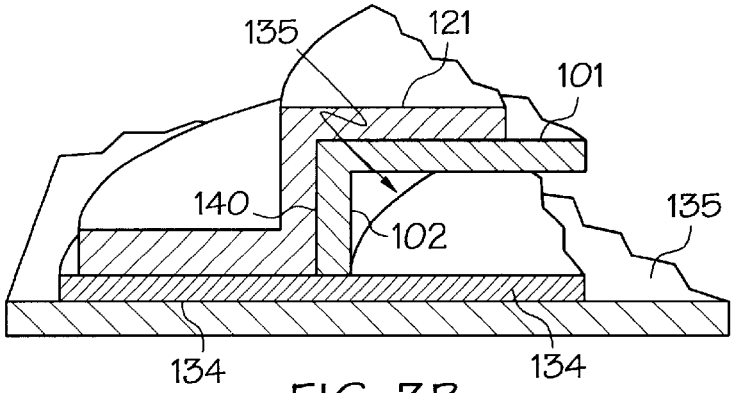
FIG. 3B is a fragmentary view with parts broken away and with parts in section of mold dies forming a flange area.

According to another embodiment, FIG. 3B, the flange 140 is substantially within the thickness of, and within the lateral perimeter of, the perimeter wall 102, without having a flange area 132. The perimeter wall 102 itself is selected for assembly and disassembly with the carrier head assembly to provide a snug-fit engagement within the inner diameter of the ring 217, thereby minimizing movement or deflection of the pad and chamber 135 relative to the ring 217 when under an applied rotation or translation by movement of the shaft 205.

Figure 4:
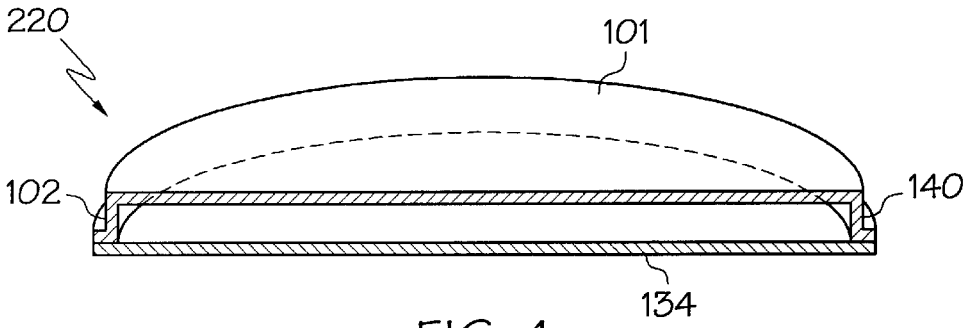
FIG. 4 is an isometric view with parts broken away of a carrier pad having a united, trimmed flange.

Fluid is confined in a hollow, fluid filled chamber 135, depicted by FIG. 4 as a single-cell, hollow, fluid filled chamber 135 having a lateral perimeter flange 140 extending a preselected distance, e.g. 1–10 mm beyond the perimeter wall 102 of the united exterior wall 221. The perimeter flange 140 provides a reinforcing flange for adding dimensional stability, thereby minimizing movement or deflection of the pad 220 and chamber 135 relative to the ring 217 when under an applied rotation or translation by movement of the shaft 205. The perimeter flange 140 faces laterally outward and opposite the interior of the confining ring 217. The perimeter flange 140 may be in removable engagement with the confining ring 217, and may press against the confining ring 217 when the carrier pad 220 undergoes compression by an applied down force used to urge a substrate against the polishing pad 206.

The hollow, fluid filled chamber 135 is hermetically sealed, and contains air, or inert gas, or a mixture of gasses at a preselected pressure, and preferably atmospheric pressure exists in the pad chamber in an uncompressed state. With the use of low gas permeability polymer materials like PVDF, and with sufficient gauge thickness of the exterior wall 221, gas pressures above atmospheric pressure could be employed. Storage of a pad 220 in a pressurized canister is readily done if internal pressures above atmospheric pressure are desired. Further, the chamber 35 contains a liquid, such as, deionized water or deionized water with an inert coloring agent, such as, a fluoroscene.

The outer dimensions of the hollow, fluid filled chamber 135 can be designed according to the carrier head assembly used in conjunction therewith. A hollow, fluid filled chamber 135 can be designed with a preselected compressed height approximately equal to the conventional pad film. The compressed height will range generally from 30 to 200 mils, especially 30–100 mils, with an outer diameter equal to the conventional carrier pad film. The uncompressed thickness or height of the hollow, fluid filled chamber 135 would be higher than a conventional pad film depending on the predetermined compression under the down force employed.

In an alternative embodiment, the uncompressed vertical height of the chamber 135 can be from 30 to 750 mils, and preferably from 50 to 150 mils. A hollow, fluid filled chamber 135 according to the present invention will compress under normal down force loads at a predetermined and predictable compression factor in a range of 10 to 40%, especially 10 to 20%, of the uncompressed height.

A chamber 135 having an uncompressed height of 100 mils, and a compression factor of 30%, e.g. a compressed height of 70 mils under the down force load, can be used in substitution of a conventional 30 mil carrier pad film. The carrier head assembly is adapted with a shim of 40 mil thickness to compensate for the compressed height of 70 mils of the thicker, hollow, fluid filled chamber 135 that is substituted for a 30 mil height of a thinner, conventional carrier pad film.

In another aspect, the invention provides a hollow, fluid filled, single-cell carrier pad 220 having a hollow, fluid filled chamber 135 made from a flexible or semi-flexible polymeric material(s). The united exterior wall 221 may be formed from single polymer compound, in a single melt, e.g. by blow molding, or selected walls 101,134 and 102 can be formed from different mutually bondable polymer compounds using other conventional fabrication methods, e.g. molding and heat-sealing. One or more methods for fabricating the chamber 135 can be readily adapted from film extrusion, conventional injection molding, compression molding, vacuum forming, blow molding, heat sealing, hot stamping, and lamination methods which are well suited to process conventional thermoplastic or thermosetting polymer compounds suitable for use as materials of construction for the chamber 135 disclosed herein.

It is preferred to employ a material for the platen wall 101 that is considered to be semi-flexible, i.e. a low flex modulus less than $2\times10^5$ p.s.i. The rear wall 134 typically can have a thickness of 10 to 50 mils, preferably 15–30 mils. For the platen wall 101, another film of the same material, or mutually bondable different material, or a material of the same polymer type but of a different, preferably lower hardness is used. Plasticized vinyl compounds are examples of similar polymer compounds that can be selected with different hardness for the rear wall 134 and platen wall 101. Polypropylene homopolymers and copolymers can be readily selected to achieve the objective of different wall flexural properties. Non-extractable, or low extractable films are more preferred.

The films 101 and 103 are formed to the desired gauge thickness by extrusion, compression, or calendaring. The films 101 and 103 are fabricated from commercially available flexible or semi-flexible thermoplastic compounds such as a TPO, TPU, vinyl, acrylic elastomer, PBT, PA-block copolymer, PTFE, PVDF, ionomers, polyolefin copolymers, TPV, SBS elastomer, and the like, to name a few. Commercial thermoplastic vulcanizable alloys (TPV's) are available from Advanced Elastomer Systems, Inc, Akron, Ohio. Commercial vinyl compounds are available from The Geon Company, Avon Lake, Ohio. Thermoplastic compounds are listed in MODERN PLASTICS Encyclopedia and Buyer's Guide, published annually by McGraw-Hill, or the Plastics Technology Manufacturing Handbook and Buyer's Guide, a supplement of PLASTICS TECHNOLOGY Magazine. Flexible vinyl compounds and TPO compounds are preferred material and are available in a wide range of flexural properties.

The hardness of the material for the united exterior wall 221 can be selected in a range from about Shore A of 20 to Shore D of about 60. According to one embodiment, a wall 221 made from a thermoplastic having a Shore A hardness in the range of 20–85, more preferably 30–70 Shore A hardness, and most preferably Shore A hardness of 35 to 45 should be suitable for the platen wall 102 and rear wall 134. In another embodiment, the platen wall 102 and rear wall 134 are formed from similar polymer materials, each having different Shore hardness. Preferably, the material of the platen wall 102 has hardness lower than the Shore hardness of the material of the rear wall 134. In this embodiment, internal webs 225 reinforcing inside the sealed fluid space may be avoided, and the chamber 135 exhibits desirable dimensional stability by stiffness in the self-supporting rear wall 134 and perimeter wall 102, which retain their shapes and orientations relative to the platen wall 101.

Figure 5:
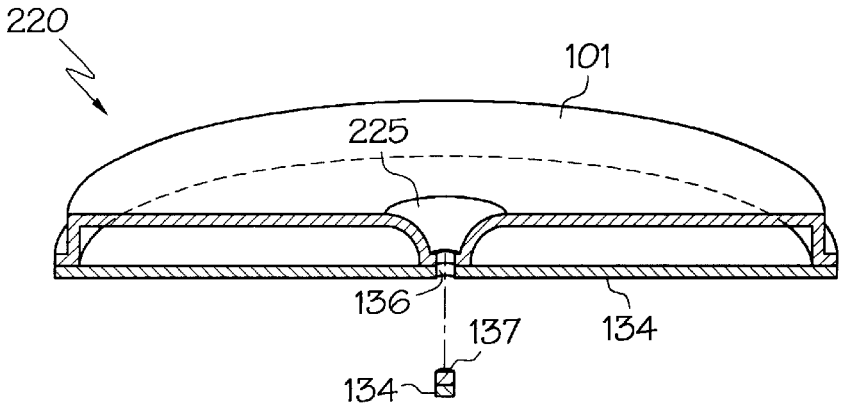
FIG. 5 is an isometric view with parts broken away of a carrier pad with a passage.

As disclosed by FIG. 5, it is desirable to provide at least one shaped passage or through bore 136 extending through the hollow, fluid filled carrier pad 220 from the rear wall 134 to the platen wall 102 to convey fluid borne pressure or fluid borne vacuum and liquid, such as deionized water.

Figure 5C:
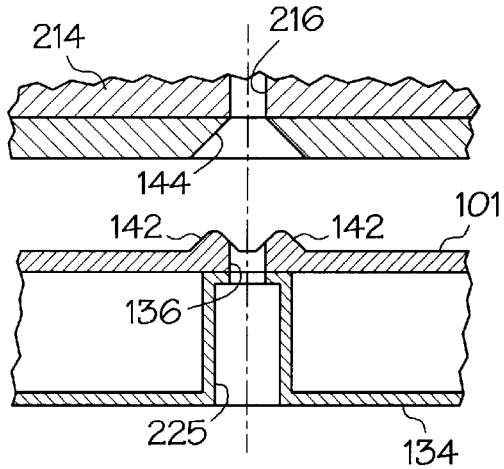
FIG. 5C is a fragmentary view with parts in section of a carrier pad having alignment projections to register in alignment recesses provided in a relatively hard platen of a carrier head assembly, or alternatively, to register in alignment recesses provided in a relatively hard carrier film on the platen of a carrier head assembly.
Figure 5A:
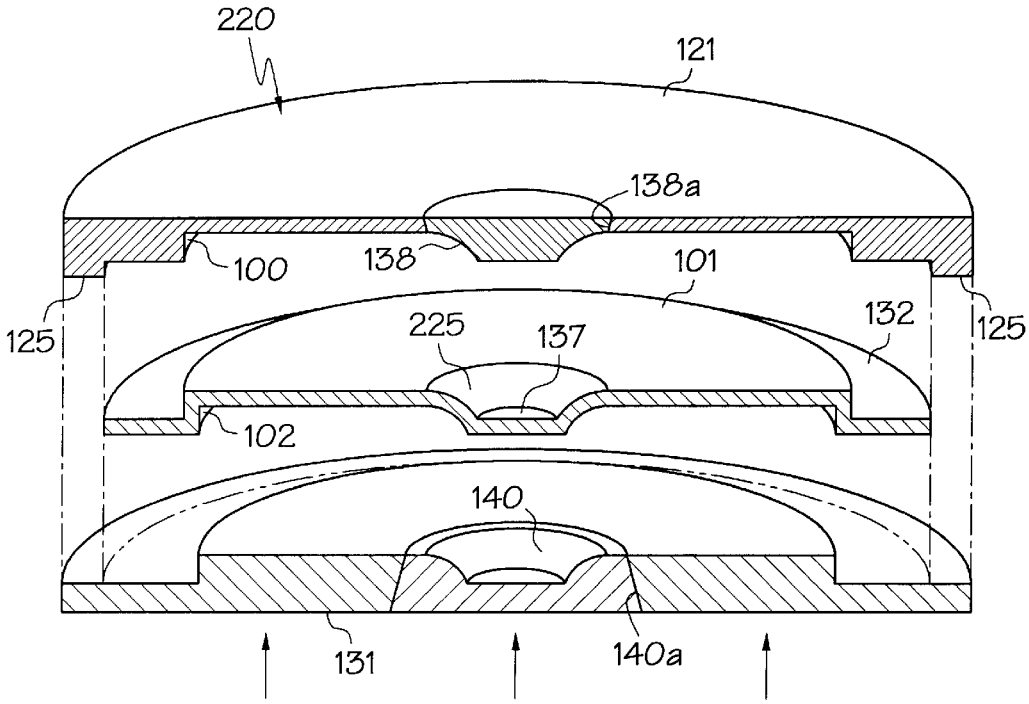
FIG. 5A is a fragmentary view with parts broken away and with parts in section of mold dies forming a carrier pad as shown in FIG. 5.
Figure 5B:
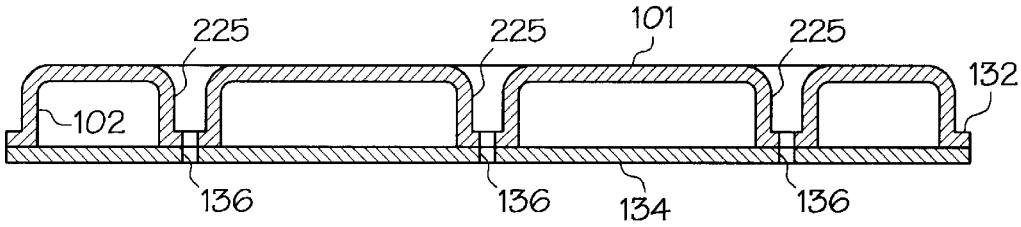
FIG. 5B is a view similar to FIG. 5, and disclosing a carrier pad with multiple passages for pressurized air to dislodge a substrate from adhesion to the carrier pad by surface tension of a polishing fluid or of a rinsing fluid, and further disclosing internal webs that support the carrier pad and resist collapse of the carrier pad.

FIG. 5B discloses multiple, spaced apart passages or through bores 136, each surrounded by unperforated, supporting interior webs 225 on the carrier pad 220. The multiple passages or through bores 136 provide for the passage of pressurized air to dislodge a substrate that adheres to the carrier pad 220 by surface tension of a polishing fluid or of a rinsing fluid. Further, the multiple passages or through bores 136 provide passages for transporting polishing fluid or rinsing fluid, or provide passages for transmitting a known optical beam to monitor the surface of a substrate during a polishing operation.

FIG. 5C discloses an embodiment of the carrier pad 220 having alignment projections 142 unitary with the platen wall 101, and formed simultaneously with the platen wall 101. The alignment projections 142 are to register in respective alignment recesses 144 provided in the platen 214, which platen 214 may include a cover film or not. FIG. 5C discloses an embodiment having a corresponding group of alignment projections 142 adapted to register with one of the respective alignment recesses 144. Although FIG. 5C discloses the alignment projections 142 adjacent to respective passages or through bores 136, the alignment projections 142 can be located anywhere along the platen wall 101 to register with appropriately located alignment recesses 144. The platen 214, which may or may not include a cover film thereof, is relatively hard, as compared to the platen wall 101 of the carrier pad 220 that is relatively soft, which provides tactile feel to detect movement of the carrier pad 220 and registration of the alignment projections 142 in the respective alignment recesses 144. Such registration aligns the carrier pad 220 relative to the platen 214. Further, such registration aligns the through bores 136 with respective passages 216 through the platen 214 and any cover film thereof. The passages 216 are provided; for compressed air, for vacuum drawing, for application of liquids, such as, deionized water and a polishing fluid, such as, a slurry or an abrasive free polishing composition, and for passage of a known optical beam to monitor the surface of a substrate during a polishing operation.

With reference to FIG. 5A, each through bore 136 can be formed, for example, by providing the molding die 121 with a corresponding, protruding core pin 138 that seats in a bore 138*a* through the mold die 121. The core pin 138 extends within a complementary shaped, core pin receiving recess provided by an opposed core pin 140 that seats in a bore 140*a* extending through the mold die 131. The core pins 138 and 140 are urged into position by a conventional molding apparatus. The recess in the core pin 140 and the exterior of the core pin 136 have the same contours, and are spaced apart to form and to maintain the thickness of the material being molded and formed. When the material to be molded and formed is a fluent material, such fluent material is shaped by the core pins 138 and 140 to provide a perimeter side of the through bore 136. When the material to be molded and formed is a thin film, the film is punched downward by the core pin 138 to form a perimeter side web of the through bore 136. A flange area 137 of the molded material initially covers the bottom of the through bore 136, and is formed in a space between the opposed core pins 138 and 140.

FIG. 5 discloses that the flange area 137 is united with the back wall 134, in the same manner as the flange area 132 is united with the rear wall 134, for example, according to the manner as disclosed in reference to FIG. 3. A portion of the flange area 137 is removed, as shown exploded in FIG. 5, for example, by die stamping, to provide a passage 136 for compressed air, for vacuum drawing and for application of liquids, such as, deionized water and a polishing fluid, such as, a slurry or an abrasive free polishing composition, and for passage of a known optical beam to monitor the surface of a substrate during a polishing operation. The surrounding webs 225 surrounding respective flange areas 137 provide interior or internal webs 225 that support the hollow carrier pad and resist its collapse.

In an alternative embodiment, the internal supporting webs 225 that interconnect with the platen wall 101 and rear wall 134, can be formed by core pins 138 and core pin receiving recesses 140 in a manner similar to formation of the side wall and the flange area 137 of the aforementioned through bore 136. The flange area 137 is sealably united with the rear wall 134, in a manner similar to that disclosed with reference to FIG. 5, and need not be removed, as it would provide an interconnecting point for a supporting web 225. Each interconnecting point with the platen wall 102 and rear wall 103 preferably has the smallest practical diameter and polymer cross sectional area to achieve dimensional stability. Each interconnecting point should each be of a predetermined crossectional area, and made of a polymer film material so as to easily deflect under the down force without introducing unacceptable localized pressure irregularities. In a regular spaced array, the pressure profile across the platen wall 101 can be designed within tolerance limits to provide relatively uniform average pressure against the substrate 202. The pattern of webs 225 causes no interference with the operation of a single fluid cell. In all cases where interconnecting points are needed for interconnecting the webs 225 to any of the platen wall 102, rear wall 134 and perimeter wall 102, the hollow, fluid filled chamber 135 remains as a single fluid cell. The total cross sectional area of the webs 225 should be less than 15%, preferably less than 10% of the total area of the platen surface 102 that equals the backside area of the substrate 102 being supported thereby.

The outside diameter, i.e. perimeter dimensions, of the hollow, fluid filled chamber 135 is less than the interior perimeter dimensions, or diameter, of the ring 217, so as to be fitted within and encircled by the ring 217. The perimeter dimensions, or outside diameter, of the hollow, fluid filled carrier pad 220 is, at least, slightly greater than the perimeter dimensions, or outer diameter, of the underlying supported substrate 202, and is larger than the substrate 202 by, at least, the thickness of the perimeter wall 102 where the perimeter wall 102 meets the platen wall 101, which provides an offset of the thickness of the perimeter wall 102 outward from the perimeter of the substrate 202 to minimize any localized higher distribution of down force transferred by the thickness of the perimeter wall 102 against the perimeter edge margin of the substrate 202.

Figure 6:
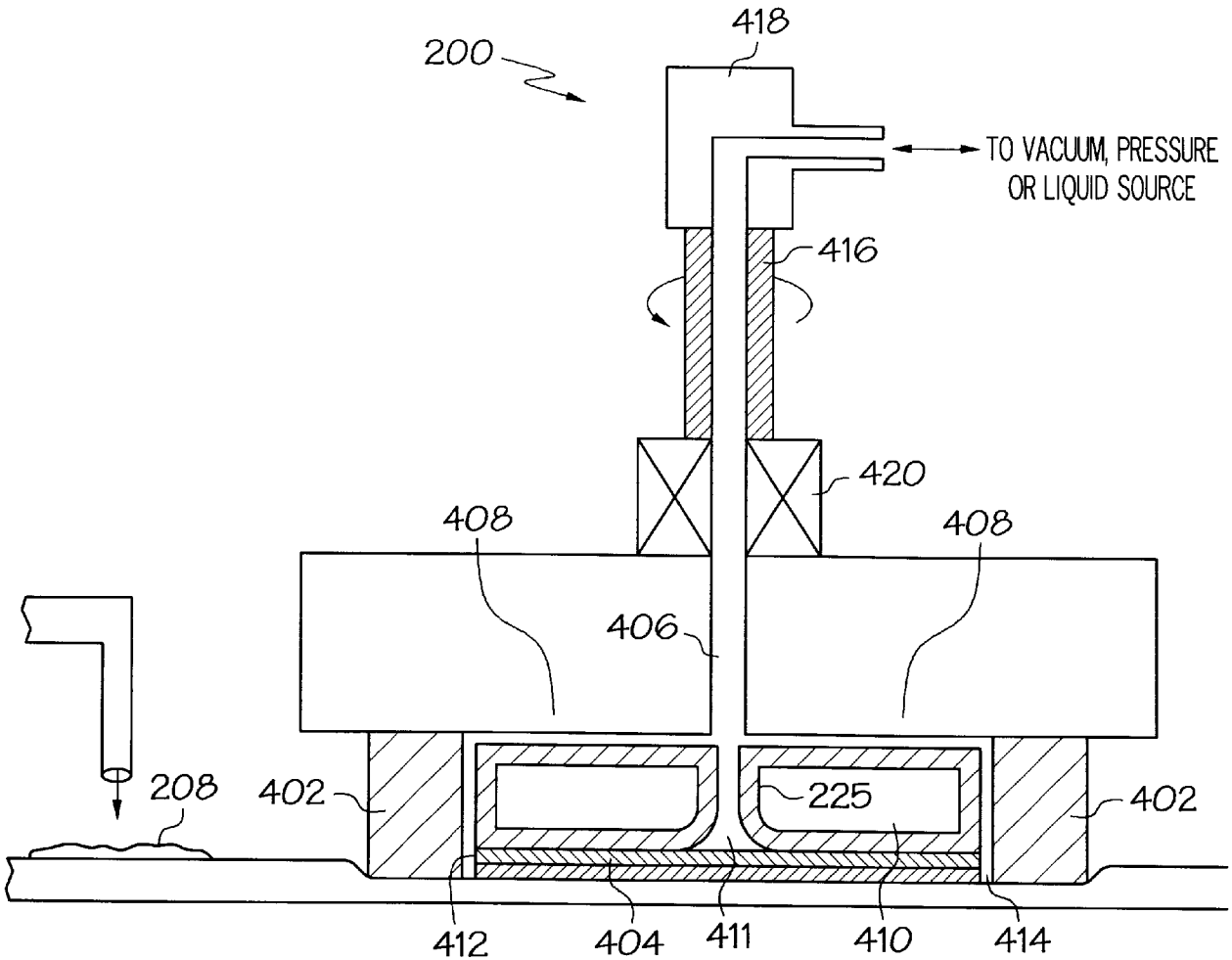
FIG. 6 is a diagrammatic view in section of a carrier head assembly including a carrier pad adapted for assembly within a substrate confining ring wherein the carrier pad has a through passage communicating with a fluid transporting conduit extending through the a platen of the carrier head assembly.

FIG. 6 depicts a section view of a substrate carrier or carrier head assembly 200 of the present invention. Substrate carrier 200 employs carrier platen 408, provided with passage or through bore 406. Hollow, fluid filled carrier pad chamber 410 is placed within the confined space of substrate confining edge or wear ring 402. Hollow, fluid filled chamber 410 transfers down force or compression force to provide a uniformly distributed polishing pressure onto the backside of the substrate to be polished. Additionally, substrate carrier 200 utilizes a wear ring 402 which is adjacent to and surrounds the lateral edge of substrate 404 to be polished. A wear ring 402 has an interior perimeter that confines a substrate 404,and serves as a substrate confining ring. The wear ring 402 is provided to impinge a polishing pad during polishing, and wears away at a known rate of removal during polishing. The wear ring 402 minimizes the edge effect of non-uniform polishing at the edge margin of a substrate 404. Lower edge of wear ring 402 lies above the plane of the lower surface of substrate 404 in a predetermined gap to retain the substrate, or alternatively the lower edge of wear ring 402 is coplanar with the lower surface of the substrate. Hollow, fluid filled carrier pad chamber 410 includes a through hole or through bore or passage 411 in which vacuum, or pressure or liquid can be transferred for retaining, releasing or wetting substrate 404 and/or carrier film 412. The chamber 400 with through hole 411 is of the same or similar construction as the pad 220 with a passage or through bore 136, as described with reference to FIG. 5. The through hole 411 communicates with the passage 406 to provide fluid to the substrate and the polishing pad. In FIG. 6, an optional, foam rubber backing pad or carrier pad film 412 such as a DF200 pad manufactured by Rodel, Inc., is placed between the backside of substrate 404 and hollow, fluid filled carrier pad chamber 410 to further cushion substrate 404 from platen 408. A plastic edge band 414 can be attached to the inside surface of wear ring 402 adjacent to the outer edge of substrate 404. Plastic edge band 414 cushions the edge of substrate 404 from wear ring 402 and thereby prevents substrate edge chipping during polishing.

Figure 7:
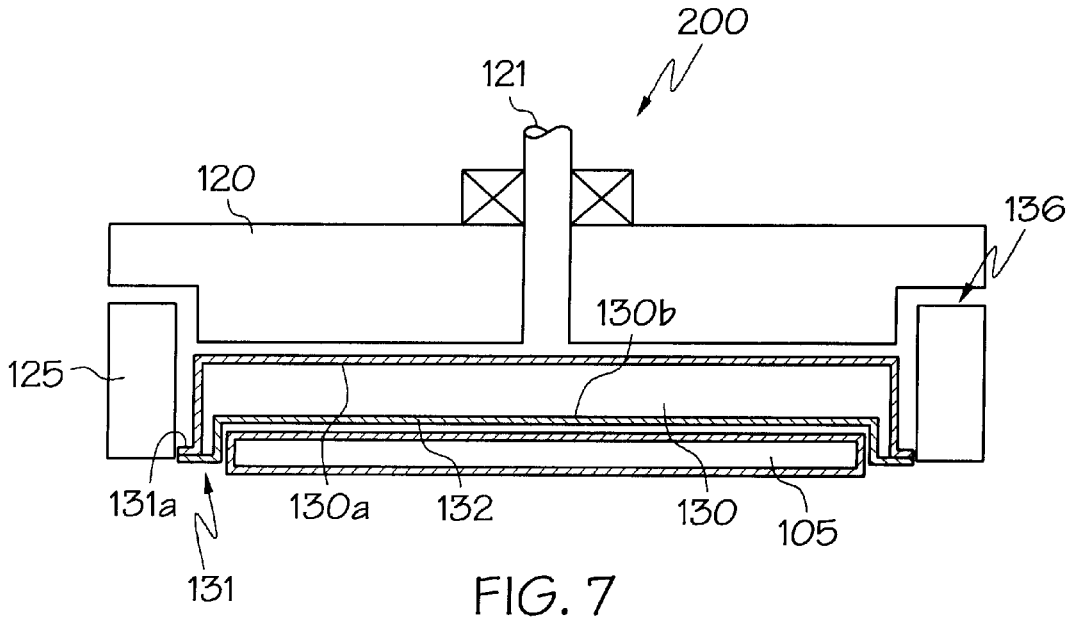
FIG. 7 is a diagrammatic view in section of a carrier head assembly having a substrate confining ring, and a hollow, fluid filled carrier pad having a substrate receiving recess that partially envelops a substrate to be polished, and with the carrier pad having a peripheral flange adapted to oppose the substrate confining ring.
Figure 8:
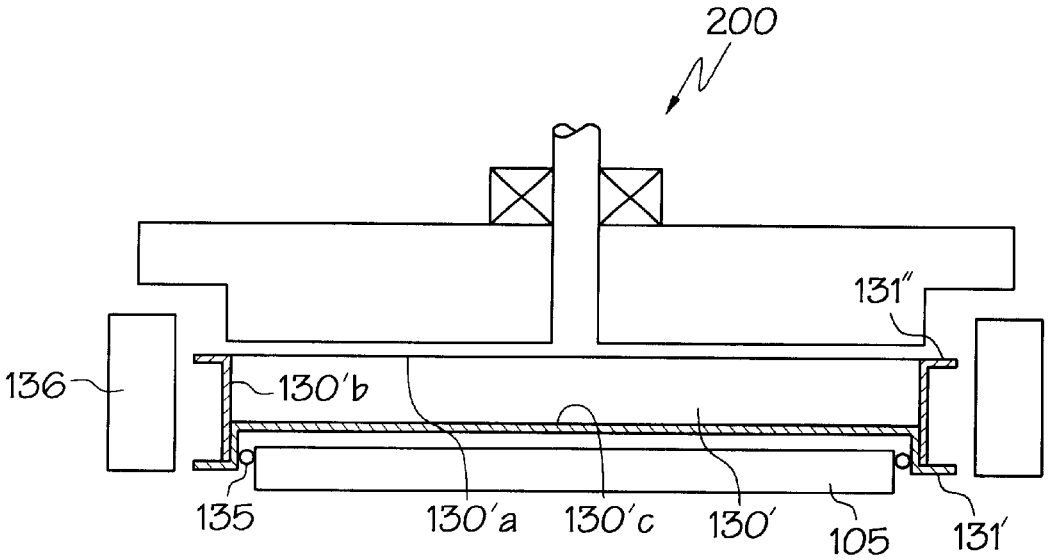
FIG. 8 is a view similar to FIG. 7, and discloses a hollow, fluid filled carrier pad having two peripheral flanges adapted to oppose the substrate confining ring.

In an alternative embodiment a shaped platen wall 101 can be formed having an integral substrate retaining recess to receive and retain the substrate, and encircle the perimeter of the substrate in a removably fitted manner, functioning similarly to a conventional edge ring. These embodiments are depicted in FIGS. 7 and 8. With reference to FIG. 7, a carrier head assembly 200 has a rigid carrier base or carrier face or platen 120 connected to rotatable shaft 121. Edge retaining or edge confining ring 125 is fitted to the carrier base 120. Removably fitted within the ring 125 is hollow, fluid filled carrier pad having a hollow, fluid filled chamber 130 which has an integral edge ring formation at substrate receiving recess 131, dimensioned to receive the backside of substrate 105 with the front surface of the substrate 105 protruding from the recess 131 for polishing. The substrate retaining, hollow, fluid filled chamber 130 has an integral edge ring or recess 131, the back wall film or rearwall 130*a* of the chamber 130 is shaped by cavity and core dies, meaning mold dies, similarly as the previously described platen wall 101 is shaped, as described with reference to FIG. 2. Face wall film or platen wall 130*b* is also shaped by cavity and core dies, meaning mold dies, of a different profile. The two walls 130*a* and 130*b* are sealably united, for example, by being heat sealed, at the flange area represented by 131. The substrate-retaining region at 131 provides a substrate retaining recess 132 fitting over the footprint of the substrate 105. The protruding lateral flange 131*a* remaining after trimming the flange area 131, also can provide retention of the chamber 130 in relation to the rigid ring 125. With reference to FIG. 8, there is depicted a three-component outer wall design for the chamber. This configuration provides two flange areas 131' and 131" to provide centering and retention of the chamber within the interior provided by the ring 136. An optional retaining band, or O-ring 135 is depicted in FIG. 8 that can be provided by retention fit against the perimeter of the substrate receiving recess of the chamber to center or offset the substrate a predetermined distance circumferentially inward of the vertical outer wall diameter 130'*b*, thereby improving the pressure profile against the substrate, and avoiding non-uniform distribution of down force by having the outer wall diameter 130'*b*, supporting the substrate.

The overall uncompressed vertical thickness of the pad chamber is defined by the sum of the thickness of the back outer wall, face outer wall and intervening free fluid space. The vertical deflection from compression is proportional to the amount of down force applied and the resistance to flexure of the materials of construction. In general, employing flexible thermoplastic materials in the walls 101, 102 and 134 with typical wall gauge thickness of from 5 to 25 mils, the chamber will compress from about 2% to 50%, preferably in the range of from 10% to 30% under the selected typical down forces that are applied to produce internal pressure, e.g. 3–12 p.s.i.g., of the substrate supporting pad, which, in turn, is applied to the substrate during polishing.

The pad chamber outer dimension, the outer wall material, and thickness of the walls 101, 102 and 134 are selected to provide a desired uncompressed thickness, and a designed compression amount under the intended operating down force desirably applied.

In its typical use, the hollow, fluid filled carrier pad chamber is inserted within the confines of the wear or edge ring that is held in position adjacent to and surrounding the outer edge of the substrate. The carrier pad chamber can be used in replacement of a poromeric carrier pad film, or alternatively a the carrier pad film can be employed together with the hollow, fluid filled carrier pad, e.g., the carrier pad film can be placed immediately above or below the hollow, fluid filled carrier pad.

What is claimed is:

1. A carrier head assembly of a substrate polishing apparatus, comprising: a substrate confining ring and a pressure exerting, substrate supporting carrier pad adapted for assembly within the substrate confining ring, the carrier pad being in the form of a hollow, sealed, hollow, fluid filled chamber that can be used in concert with a fluid providing surface tension adhesion of a substrate to be polished, the chamber further being adapted to be compressed by a down force, and become internally pressurized with a uniform internal pressure that uniformly distributes the down force over the backside of a supported substrate to be polished, and the carrier pad having internal perforated reinforcing webs joined to a substrate supporting platen wall.

2. The carrier head assembly as recited in claim 1 wherein, the carrier pad has a perimeter flange opposing the interior of the substrate confining ring.

3. A carrier head assembly of a substrate polishing apparatus, comprising: a substrate confining ring and a pressure exerting, substrate supporting carrier pad adapted for assembly within the substrate confining ring, the carrier pad being in the form of a hollow, sealed, hollow, fluid filled chamber that can be used in concert with a fluid providing surface tension adhesion of a substrate to be polished, the chamber further being adapted to be compressed by a down force, and become internally pressurized with a uniform internal pressure that uniformly distributes the down force over the backside of a supported substrate to be polished, and the carrier pad having a substrate receiving recess.

4. The carrier head assembly as recited in claim 3 wherein, the carrier pad has a substrate receiving O-ring against a perimeter of the substrate receiving recess.

5. A carrier head assembly of a substrate polishing apparatus, comprising: a substrate confining ring and a pressure exerting, substrate supporting carrier pad adapted for assembly within the substrate confining ring, the carrier pad being in the form of a hollow, sealed, hollow, fluid filled chamber that can be used in concert with a fluid providing surface tension adhesion of a substrate to be polished, the chamber further being adapted to be compressed by a down force, and become internally pressurized with a uniform internal pressure that uniformly distributes the down force over the backside of a supported substrate to be polished, the carrier pad having a perimeter wall united with a substrate supporting platen wall, and the perimeter wall being offset outward from an area of the platen wall that supports an edge margin of a substrate to be supported by the platen wall.

6. A substrate supporting carrier pad comprising: a hollow, sealed, hollow, fluid filled chamber adapted to be compressed by a down force during a substrate polishing operation to become internally pressurized with a uniform internal pressure that uniformly distributes a down force over the backside of a supported substrate to be polished, the chamber having a substrate supporting platen wall for supporting a substrate, a rear wall and a perimeter wall united with the platen wall and the rear wall, and the rear wall being fabricated of a first polymer having a hardness greater than a second polymer of which said platen wall is fabricated.

7. A substrate supporting carrier pad comprising: a hollow, sealed, fluid filled chamber adapted to be compressed by a down force during a substrate polishing operation to become internally pressurized with a uniform internal pressure that uniformly distributes a down force over the backside of a supported substrate to be polished, and at least one fluid transmitting passage through the carrier pad, said passage extending from the rear wall to the platen wall and being surrounded by an interior web.

8. A substrate supporting carrier pad comprising: a hollow, sealed, hollow, fluid filled chamber adapted to be compressed by a down force during a substrate polishing operation to become internally pressurized with a uniform internal pressure that uniformly distributes a down force over the backside of a supported substrate to be polished, and internal perforated reinforcing webs joined to the substrate supporting platen wall.

9. A substrate supporting carrier pad comprising: a hollow, sealed, hollow, fluid filled chamber adapted to be compressed by a down force during a substrate polishing operation to become internally pressurized with a uniform internal pressure that uniformly distributes a down force over the backside of a supported substrate to be polished, and a substrate receiving recess in the substrate supporting platen wall.

10. A substrate supporting carrier pad comprising: a hollow, sealed, hollow, fluid filled chamber adapted to be compressed by a down force during a substrate polishing operation to become internally pressurized with a uniform internal pressure that uniformly distributes a down force over the backside of a supported substrate to be polished, and the substrate supporting platen wall having a substrate receiving recess, and a substrate receiving O-ring against a perimeter of the substrate receiving recess.

11. A substrate supporting carrier pad comprising: a hollow, sealed, hollow, fluid filled chamber adapted to be compressed by a down force during a substrate polishing operation to become internally pressurized with a uniform internal pressure that uniformly distributes a down force over the backside of a supported substrate to be polished, and the perimeter wall being offset outward from an area of the platen wall that supports an edge margin of a substrate to be supported by the platen wall.

12. A substrate supporting carrier pad comprising: a hollow, sealed, hollow, fluid filled chamber adapted to be compressed by a down force during a substrate polishing operation to become internally pressurized with a uniform internal pressure that uniformly distributes a down force over the backside of a supported substrate to be polished, and interior webs supporting the carrier pad and resisting collapse of the carrier pad.

13. The substrate supporting carrier pad as recited in claim 12, and further comprising: alignment projections located on the carrier pad so as to register with alignment recesses in a portion of a carrier head assembly of a polishing apparatus.

14. The substrate supporting carrier pad as recited in claim 12, and further comprising: passages extending through the carrier pad surrounded by the interior webs.

15. The substrate supporting carrier pad as recited in claim 14, wherein, said passages are conveyors of fluid borne pressure or fluid borne vacuum.

16. The substrate supporting carrier pad as recited in claim 14 wherein, said passages are conveyors of liquid.

17. The substrate supporting carrier pad as recited in claim 12, and further comprising: passages extending through the carrier pad surrounded by the interior webs, and alignment projections located on the carrier pad so as to register with alignment recesses in a portion of a carrier head assembly of a polishing apparatus, and said alignment projections being adjacent to said passages.

18. A substrate supporting carrier pad comprising: a hollow, sealed, hollow, fluid filled chamber adapted to be compressed by a down force during a substrate polishing operation to become internally pressurized with a uniform internal pressure that uniformly distributes a down force over the backside of a supported substrate to be polished, at least one passage extending through the carrier pad, and said passage being surrounded by an interior web supporting the carrier pad and resisting collapse of the carrier pad.

19. A substrate supporting carrier pad as recited in claim 17 wherein, said passage is for transmission of an optical beam to monitor a surface of a substrate supported on the carrier pad.

* * * * *